United States Patent [19]

Shelton

[11] 4,121,782

[45] Oct. 24, 1978

[54] YARN STORAGE FEEDERS

[75] Inventor: William Ewart Alan Shelton, Oadby, England

[73] Assignees: Alan Shelton Limited; The Bentley Engineering Group Limited, both of England

[21] Appl. No.: 797,440

[22] Filed: May 16, 1977

[30] Foreign Application Priority Data

May 22, 1976 [GB] United Kingdom ..... 21289/76
Feb. 17, 1977 [GB] United Kingdom ..... 06595/77

[51] Int. Cl.[2] ..... B65H 51/20; B65H 51/22
[52] U.S. Cl. ..... 242/47.12
[58] Field of Search ..... 242/47.01, 47.08, 47.09, 242/47.1, 47.11, 47.12, 47.13; 66/132 R, 132 T

[56] References Cited

U.S. PATENT DOCUMENTS

| | | | |
|---|---|---|---|
| 3,419,225 | 12/1968 | Rosen | 242/47.12 |
| 3,791,598 | 2/1974 | Vischiani et al. | 242/47.12 |
| 3,827,645 | 8/1974 | Rosen | 242/47.12 |
| 3,921,925 | 11/1975 | Sarfati et al. | 242/47.12 |
| 3,924,818 | 12/1975 | Pfeifle | 242/47.12 X |
| 4,028,911 | 6/1977 | Fecker et al. | 242/47.01 X |
| 4,044,962 | 8/1977 | Calamani et al. | 242/47.12 X |

*Primary Examiner*—Stanley N. Gilreath
*Attorney, Agent, or Firm*—Charles E. Brown

[57] ABSTRACT

The invention relates to yarn storage devices of the type in which a single layer of yarn turns are accommodated on a drum. The drum according to the invention comprises longitudinal members, for example rods or struts, along which a plurality of yarn displacing members are made to slide by cam means as the yarn is wound onto the drum. Where the drum is rotated relative to a stationary cam means, the drive may be through a form of friction clutch.

11 Claims, 7 Drawing Figures

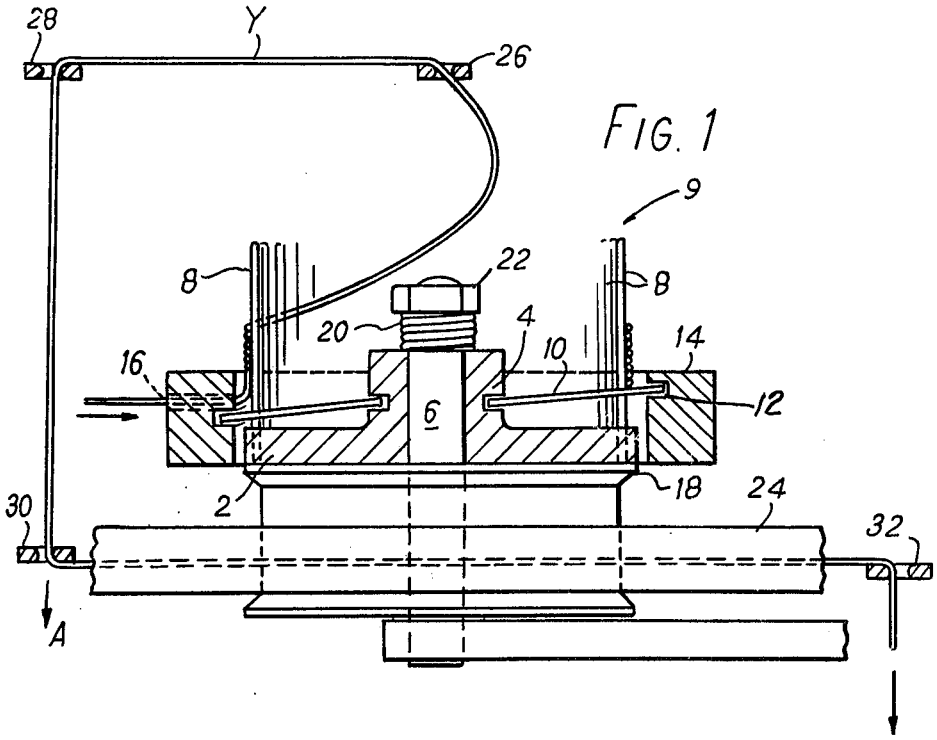
FIG. 1
FIG. 2
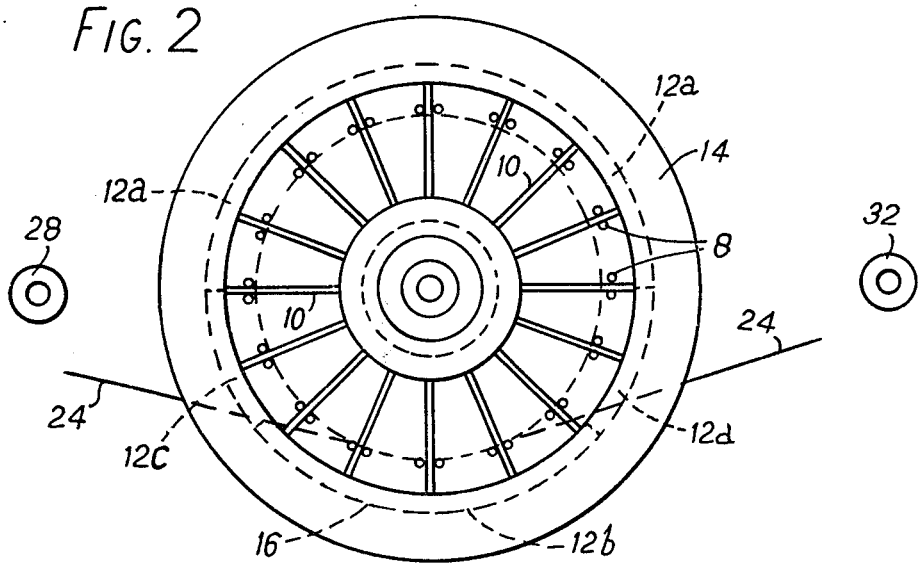

FIG. 3
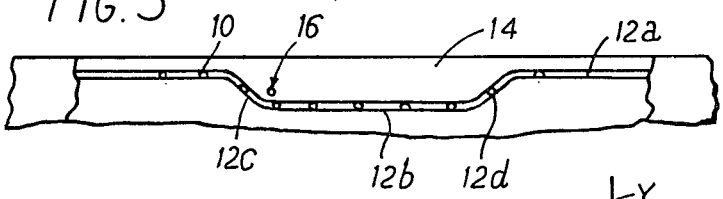
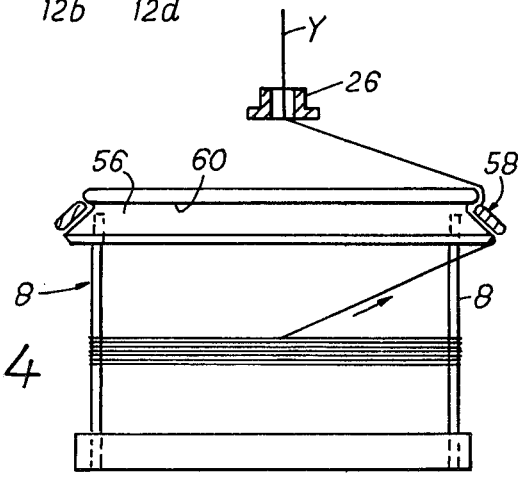
FIG. 4
FIG. 5
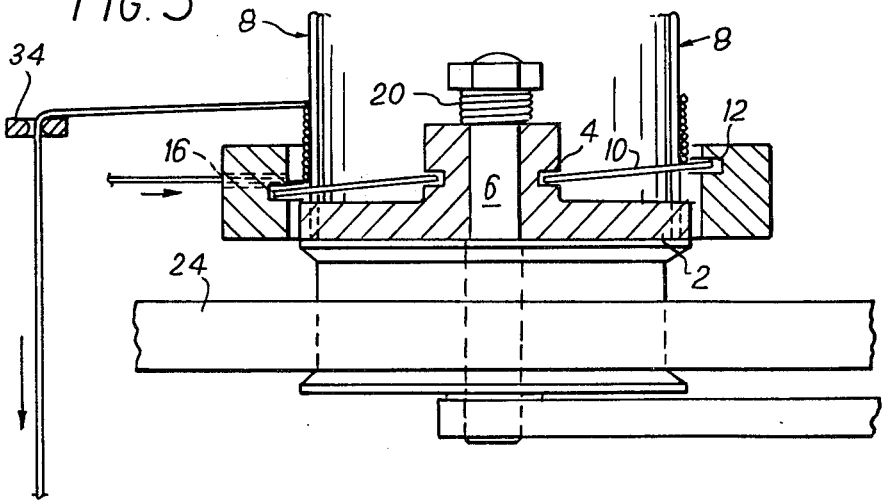

YARN STORAGE FEEDERS

BACKGROUND OF THE INVENTION

The invention is concerned with improvements in or relating to yarn feed devices, particularly devices having a yarn storage capacity.

Yarn feed devices are used in a variety of applications in the textile industry wherever a yarn or yarns is/are required to be fed to a machine under controlled tension, at either a uniform rate, a changeable rate or at intermittent intervals. A type of yarn feed device in common use and to which type this invention relates is known as a yarn storage feeder and comprises a support in the form of a drum around which are wound a plurality of turns of the yarn as received from the bobbin and this stored yarn is pulled off in the required manner independently of the rate at which it was initially fed to the device.

Many of these yarn storage devices are expensive to manufacture and maintain and it is an object of the present invention to provide a device which is simple to manufacture and consequently economical in cost, and which operates in an efficient and versatile maner.

BRIEF DESCRIPTION OF THE INVENTION

The invention therefore provides a yarn feed device of the above type comprising a storage drum adapted to accommodate a plurality of wound turns of yarn in a single layer, yarn displacing means to displace wound turns of yarn progressively in a direction longitudinally of the drum and comprising a plurality of yarn displacing members, longitudinally disposed members arranged in circular formation around the periphery of the drum and defining paths for longitudinal movement of said yarn displacing members, and a continuous cam surface adjacent said members engaging with said yarn displacing members so that relative rotary movement between the drum and the cam surface imparts lengthwise movement of the yarn displacing members relative to the longitudinally disposed members.

In one example of the invention to be described hereinafter, the yarn displacing members comprise levers pivotally mounted for lengthwise movement on a central mounting portion of a base plate, the levers extending radially so as to protrude between the longitudinally disposed members which are in the form of rods or struts so that tip portions of the levers engage with the continuous cam surface. Thus their lengthwise movement is in a defined path acheived either as the drum, and therefore the levers, rotate with respect to the cam surface, or as the cam surface is rotated with respect to the drum. Clearly in the latter instance, provision must be made to lead the yarn around the stationary drum.

In this first mentioned example, the levers are mounted for pivotal movement in a vertical plane passing through the axis of the drum and the movement may be controlled by the cam surface, which is in the form of a cam track, between an upper position and a lower position occupied by successive levers during the relative movement between the drum and the cam member. When the yarn is drawn off from the top of the drum the levers will be in their lowest position as they pass the point of supply of the yarn onto the storage drum, so that the turns of yarn are formed above the protruding end portions of the levers. As the levers are raised under the control of the cam track, so the wound turns are pushed upwardly on the rods to make room for subsequent turns.

In a second example, the yarn displacing members are mounted for lengthwise sliding movement on the longitudinally disposed members which again are in the form of rods or struts, projecting portions of the members extending radially outwardly thereof so as to engage with the continuous cam surface.

The sliding movement of the yarn displacing members is controlled by the cam surface between a lower, yarn receiving level and a higher level in which the members press the newly received yarn against the turns already stored on the drum. It is advantageous if the higher level extends at least halfway (180°) around the cam surface in order to even out the pressure exerted on the turns as much as possible, e.g., to avoid "riding up" of the turns of yarn on the drum.

Conveniently, the rods of the drum may be arranged in pairs, each lifting member spanning the two adjacent rods of a pair for stability. The cam track may conveniently be arranged externally of the drum, the lowest portion of the cam surface being arranged to face the incoming yarn from the yarn feed device, the yarn being then received on an upper face of the member. As the drum continues to rotate, the members lift the yarn until it is pressed against the turns already wound onto the drum, causing these turns to slide upwardly on the rods or struts.

The uppermost turn of yarn on the drum is taken off the drum according to the requirements of the machine to which the yarn is being fed.

Several arrangements for operation of the device are possible within the scope of the invention. For example, when the yarn drawn off from the yarn feed device is required to be delivered to a textile machine at a uniform rate, this may be readily achieved with a yarn feeding action which is very positive, by arranging a tangential take-off angle for the yarn, the number of turns stored on the drum remaining constant, as the yarn passes around the drum which acts in a manner not unlike that of a capstan.

Where the yarn is drawn off in a more axial direction, a so-called "over-end" take-off, whether the take-off is required to be at a constant rate, an accelerating or decelerating rate or at an intermittent rate, it is normally arranged that the rate at which the yarn is wound on to the drum is greater than that at which it is taken off. While this ensures that there are always stored turns present on the drum it does necessitate control of the build-up of yarn in relation to the capacity of the drum, and at frequent intervals, the storage capacity will be taken up to a point where the winding movement must temporarily cease. In a preferred example of the invention, therefore, the drum is rotatably driven by a frictional drive arrangement comprising a co-axially driving wheel acting on the underside of the base plate supporting the rods or bars of the drum. When it is required to stop rotation of the drum, the base plate may be lifted in any suitable manner and the drive disconnected until further storage capacity is available. Thus, the provision for lifting the drum out of contact with the drive while maintaining the operating parts in an undisturbed condition, surprisingly results in a simple highly efficient apparatus.

A particular advantage of this feature may be appreciated by comparison with the situation where a storage device is driven by an in-built electric motor. In order to reduce the frequency with which operation of the on/off switch of the motor would otherwise occur, a number of solutions have been suggested, for example if the yarn store can be built up to a large amount by forming the store in a "loose ball" rather than a single layer of yarn on the drum, the frequency of stopping and re-starting the winding operation can be minimized In order to achieve this "loose ball" effect, it is necessary to feed yarn into the drum at relatively low tension. Devices incorporating the feature above described are not subject to the restriction of requiring infrequent stopping and starting, owing to the simple clutch drive to the drum and may, therefore, operate advantageously with a relatively high input tension.

In circumstances when the yarn is required to be used at a uniform rate by the textile machine, a feed device according to the present invention may be placed in advance of, for example, a positive feed device where the yarn is nipped between a belt and an associated pulley, operating at a constant rate relative to the knitting machine.

In alternative circumstances, the yarn may be required to be provided with a greater degree of tension than the controlled tension provided by the device according to the invention. Since the yarn is being drawn off from the upper portion of the drum, then this additional tension may be obtained by causing the yarn either to pass over a rubbing lip having a surface with a co-efficient of friction suitable to the characteristics of the yarn itself or to pass beneath a retarding ring which may be in the form of a rigid annular member resting by gravity on the upper portion of the drum. Alternativey, where the apparatus is other than in the upright position shown in the examples, a retarding ring may be used having resilient finger such as is shown in British Pat. No. 1239182.

BRIEF DESCRIPTION OF DRAWINGS

There will now be described in detail several examples of yarn feed devices according to the invention. It will be understood that the description is given by way of example only and not by way of limitation.

In the drawings:

FIG. 1 shows a diagrammatic side elevational view partly in section of a first device according to the invention;

FIG. 2 shows a plan view of the device of FIG. 1;

FIG. 3 shows a view of a cam track of the device of FIG. 1;

FIG. 4 shows a side elevational view of a second device according to the invention;

FIG. 5 shows an alternative operative arrangement for use with the device of FIG. 1;

DETAILED DESCRIPTION OF DRAWINGS

Figure 6:
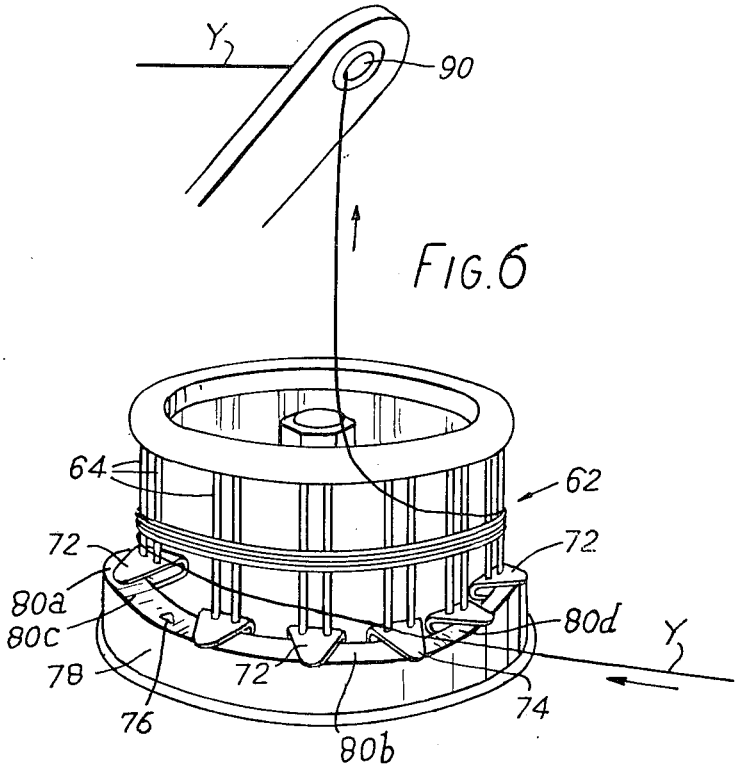
FIG. 6 shows a persepctive view of a third device according to the invention.

FIG. 1 shows a circular base plate 2 having a central annular mounting portion 4 positoned upon a shaft 6. Arranged around the periphery of the plate 2 are 32 longitudinally disposed members in the form of rods 8, arranged in pairs (see FIG. 2) to define a plurality of longitudinal tracks. The rods 8 comprise a drum 9. Mounted in the annular portion 4 for vertical pivotal movement are sixteen yarn displacing members in the form of levers 10, one passing between each pair of rods so as to protrude beyond the cylinder or drum formed by the rods. Extreme end portions 11 of the levers 10 are received in a cam track 12 formed in the inner cylindrical surface of an annular cam member 14. The shape of the cam track can be seen in FIG. 3 to comprise a main upper level portion **12*a* which extends around approximately 180° of the annular member and a lower level portion 12*b* between two transitional level cam track portions 12*c* and 12*d*. A yarn entry aperture 16 is formed in the member 14 adjacent the cam track portion 12*c***.

The plate 2 is normally held in frictional driving cntact with a co-axial driving wheel 18, in the manner of a friction clutch, by means of a spring 20 acting between the top surface of the annular portion 4 and a retaining nut 22 on the upper end of the shaft 6. The wheel 18 is driven by contact with a belt 24 which in the present example acts also as a yarn feeding device capable of supplying yarn at a uniform tension and rate to a textile machine, as will be hereinafter more fully explained.

In operation a yarn Y enters the device through the aperture 16 in the stationary cam member 14. The drum, being in frictional driving contact with the wheel 18 is rotating and causes the yarn to be wound around the drum formed by the rods 8 in a plurality of turns. As the yarn enters at the low level, **12*b*, of the cam track, the levers 10 are in a downward, inclined position (see FIG. 1, at the left hand side) and the yarn commences to wind immediately above these levers. As the end portions 11 of the levers travel in the track so they rise up the cam track portion 12*d* until they reach the upper level 12*a*. In doing so they cause the fresh turn of yarn to be raised and to push upwardly against the last wound turn to push all the turns upward in close contact. The yarn is drawn off from the top turn of the wound yarn and passes through a yarn guide in the form of an eye 26 in a substantially tension-free condition. However, a certain amount of tension is desirable for proper control and this is conveniently imparted by causing the yarn to leave the eye 26 in a radially extending path and to turn through 90° as it passes through a further eye 28**. Alternative forms of tensioning device may be used, if preferred, such as a cymbal tensioner.

When the end use requires an intermittent or accelerating and decelerating rate of feed, and the uniform rate facility is not required, FIG. 1 shows the alternative yarn path downwards through guide 30 direct to the textile machine (not shown), in the direction of arrow A.

When the end use requirement is for yarn to be provided at uniform rate, the yarn path is controlled through guide eyes 30 and 32, causing the yarn to pass between the nip of the belt 24 and the wheel 18, the speeds of which are adjusted by known means to suit the yarn feed rate required. In this arrangement, yarn at uniform tension is drawn from the drum and fed at uniform rate to the end use point.

An alternative arrangement by which uniform rate may be achieved may be provided, in which both the feeding on of the yarn through the entry aperture 16 and the take-off of the yarn from the top turn is at an angle tangential to the circle of rods 8 which comprises the drum. The yarn is passed directly to the textile machine through an eye 34. The yarn feed achieved by this arrangement is very positive, being not unlike the operation of a capstan. The number of turns around the drum remain constant in this arrangement since the feed-on rate and the take-off rate are identical.

The device is arranged so that the drum formed by the rods 8 is of slightly larger diameter than that of the wheel 18. This is to ensure that the winding-on speed to the drum is potentially greater than to the wheel 18 when the two are rotating in unison. The reason for this is that the input yarn tension from the supply bobbin may be high and the degree of stretch imparted to certain types of yarn can be considerable.

Thus under these circumstances the length of yarn per turn wound tightly onto the drum would be less than the length required to be delivered by one revolution of the wheel 18, assuming both wheels to be the same size.

It will be seen therefore that because the drum has a greater winding-on capacity than the wheel 18, the buildup of the yarn store must be regulated according to the demand of the wheel 18. This necessitates a stop/-start or acceleration/deceleration of the drum to limit the amount of yarn in the store between predetermined upper and lower limits.

In the present example, the continual upwards thrust of the levers 10 causes each new turn of yarn to be pushed upwards under the previous turn, causing the accumulated yarn to be pushed up the rods 8 of the drum. By the input yarn tension, the turns of yarn will have a certain friction against the outer wall of the drum and, as the number of turns increases, it will become difficult to push the store any higher. Since the drum is free to move up the shaft 6, the upwards pressure of levers 10 against the yarn store will eventually raise the base plate 2, thus disengaging it from the drive of the wheel 18.

When the drum stops turning, the yarn store will diminish to the point where the spring pressure plus the weight of the base plate 2 will be sufficient to depress the plate 2 back into contact with the wheel 18 and the on-wind of yarn to replenish the store will recommence.

If, as in the present example, the drum diameter is 10% larger than that of the wheel 18, the period of engagement of the two will be approximately 90% of the time during running at uniform rate of yarn feed to the end use point. Means are available under conventional systems to regulate the rate of yarn fed by the wheel 18 and the belt 24 to suit the demand of the end use process.

FIG. 4 shows an alternative example of a means of taking off the yarn from the drum, in which the upper portion of the drum is provided with a contoured cap 56 upon which rests a rigid ring 58. The ring 58 is captive on the cap 56 being received in a groove 60 in a manner to allow the yarn to pass between the cap and the ring, the latter applying tension through its own weight. The yarn then passes through the guide eye 26 as before.

FIG. 5 shows a yet further alternative arrangement in which the yarn take-off path is tangential.

Figure 7:
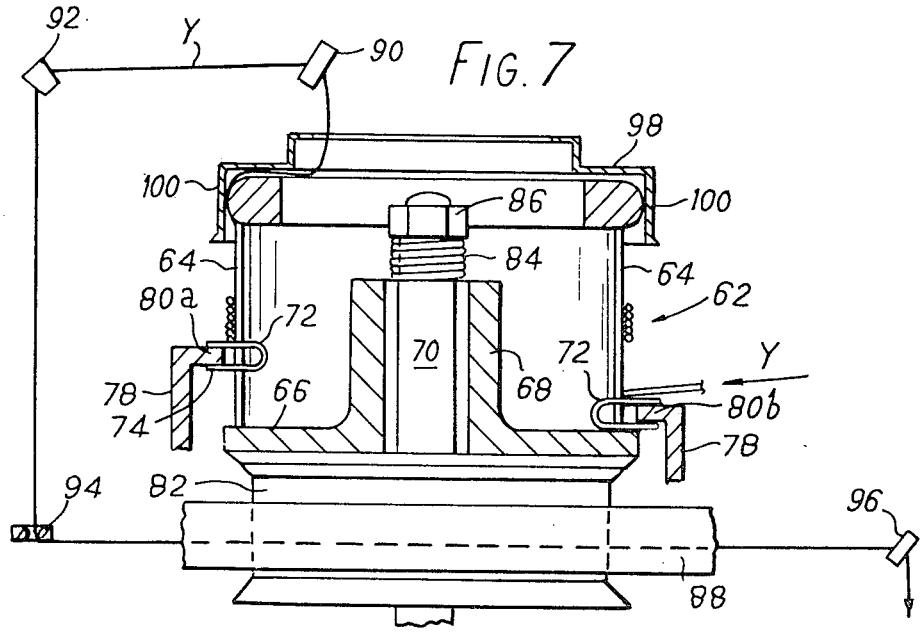
FIG. 7 shows a diagrammatic side view of the device shown in FIG. 6, partly in section, and showing drive means.

FIGS. 6 and 7 show a second embodiment of the invention in which a drum 62 is formed from rods 64 upstanding in pairs from the periphery of a base plate 66 (FIG. 7). This base plate 66 has a central annular mounting portion 68 positioned upon a shaft 70. Mounted so as to span adjacent ones of a pair of longitudinally disposed members in the form of rods 64 are a plurality of yarn displacing members 72 through holes in which the rods freely pass. Two outwardly projecting portions 74 of each member 72 lie above and below, respectively, a projecting cam surface 76 supported in an annular cam member 78. The shape of the cam surface 76 is such as to comprise a main upper level portion **80*a* which extends around approximately 180° of the member 78 and a low level portion 80*b* adjacent the feed-in point of a yarn Y, which is arranged between two oppositely sloping portions, 80*c*, 80*d***.

The plate 66 is normally held in frictional driving contact wth a co-axial driving wheel 82, in the manner of a friction clutch, by means of a spring 84 acting between the top surface of the annular portion 68 and a retaining nut 86 on the upper end of the shaft 70. The wheel 82 is driven by contact with a belt 88 which in the present example acts also as a yarn feeding device capable of supplying yarn at a uniform tension and rate to a textile machine, as will be hereinafter more fully explained.

In operation the yarn Y is received on the drum which, being in frictional driving contact with the wheel 82, is rotating and causes the yarn to be wound around the drum formed by the rods 64 in a plurality of turns. As the yarn is received at the low level of the cam surface, the yarn-displacing members 72 are in their lower position (see FIG. 7, at the right hand side) and the yarn commences to wind immediately above these members. As the members 72 travel along the surface 76 so they rise up the cam surface portion **80*c* and therefore the rods 64 until they reach the upper level 80*a*. In doing so they cause the fresh turn of yarn to be raised and to push upwardly against the last wound turn to push all the turns upward in close contact. The yarn is drawn off from the top turn of the wound yarn and passes through a yarn guide in the form of an eye 90 in a substantially tension-free condition. However, a certain amount of tension is desirable for proper control and this is conveniently imparted by causing the yarn to leave the eye 90 in a radially extending path and to turn through approximately 90° as it passes through a further eye 92. An arrangement for imparting tension in a positive manner is shown in FIG. 7 in which yarn is drawn off between the upper portion of the drum 62 and a restraining sleeve 98. The sleeve 98 acts as a gravity tensioner and is of rigid and robust construction, not liable to be damaged easily. It is provided with a skirt portion 100, which in the present example is transparent and the yarn passes between the sleeve and the drum 62, the former applying tension through its own weight. The yarn then passes through the guide eye 90** as before. Alternative forms of tensioning device may be used, if preferred, such as a cymbal tensioner.

When the end use requirement is for yarn to be provided at uniform rate, the yarn path is controlled through guide eyes 94 and 96, causing the yarn to pass between the nip of the belt 88 on the wheel 82. In this way, yarn at uniform tension is fed at uniform rate.

In an alternative arrangement (not shown) by which uniform rate may be achieved, both the feeding on of the yarn and the take-off of the yarn from the top turn is at an angle tangential to the rods 64 of the drum 62. The yarn is passed directly to the textile machine through an eye which is suitably positioned. The yarn feed achieved by this arrangement is very positive, being not unlike the operation of a capstan. The number of turns around the drum remain constant in this arrangement since the feed-on rate and the take-off rate are identical.

When the end use requires an intermittent or accelerating and decelerating rate of feed, and the uniform rate facility is not required, the yarn may pass downwards through guide 94 direct to the textile machine (not shown).

The device is arranged so that the drum 62 formed by the rods 64 is of slightly larger diameter than that of the wheel 82. The reasons for this are as explained above.

In this example, the continual upwards thrust of the members 72 causes each new turn of yarn to be pushed upwards under the previous turn, causing the accumulated yarn to be pushed up the surface of the drum as described in connection with the previous example.

The drum 62 is driven by the wheel 82 in the same way that the drum 9 is driven by the wheel 2, the drum diameter being 10% larger than that of the wheel 82, the period of engagement being approximately 90% of the time during running at uniform rate of yarn feed to the end use point.

I claim:

1. A yarn feed device comprising a storage drum defining means for accommodating a plurality of wound turns of yarn in a single layer, said storage drum including a plurality of longitudinally disposed members arranged in a circular formation around the periphery of the drum, longitudinally extending paths defined by said longitudinally disposed members, a continuous cam surface adjacent said longitudinally disposed members, yarn displacing means movable within said paths to displace wound turns of yarn progressively in a direction longitudinally of said drum and comprising individually movable yarn displacing members, the yarn displacing members extending generally radially of the drum to pass between and protrude radially beyond said longitudinally disposed members, said yarn displacing members having portions engaging said continuous cam surface, and drive means for causing relative rotary movement between said drum and said continuous cam surface, said drive means including frictional contact of a driven member with a driving member, and frictional contact interrupting means for temporarily interrupting said frictional contact when the number of turns on the drum has reached a predetermined maximum.

2. A device as claimed in claim 1 together with a mounting portion concentric wth said drum on which each yarn displacing memeber is pivotally mounted.

3. A device as claimed in claim 1 wherein the continuous cam surface has four portions including a main portion, a yarn entry portion, and two oppositely sloping intervening portions, and means for defining an entry point of the yarn onto said drum situated at the level of said yarn entry portion.

4. A device as claimed in claim 1 wherein said longitudinally disposed members are rods or struts.

5. A device as claimed in claim 3 wherein there is provided yarn tensioning means for imparting tension to the yarn leaving said drum.

6. A device as claimed in claim 5 wherein said drum is vertically oriented and said yarn entry portion of said continuous cam surface is the lowest portion, and wherein said yarn tensioning means include a restraining sleeve encircling a take-off portion of the drum, the yarn passing between the sleeve and the drum, the former applying tension through its weight.

7. A device as claimed in claim 1 wherein said drum is mounted for rotation about a vertical axis and for vertical movement along said axis, and said drive means includes a rotating member underlying said drum with said drum being seated on said rotating drum and in frictional contact therewith.

8. A device as claimed in claim 1 wherein said yarn displacing memebers are individual members carried by respective ones of said longitudinally disposed members for guided movement thereon.

9. A device as claimed in claim 8 wherein said individual yarn displacing members are C-shaped and have two legs, there being oppositely facing ones of said cam surfaces, said legs being disposed to engage said oppositely facing cam surfaces.

10. A device as claimed in claim 9 wherein said cam surfaces are disposed exteriorly of said drum.

11. A device as claimed in claim 1 wherein said yarn displacing members comprise levers pivotally mounted on a mounting portion arranged centrally of the drum for lengthwise movement relative to said drum, said levers extending radially from said mounting portion and protruding between adjacent ones of said longitudinally disposed portions with tip portions of said levers engaging with said continuous cam surface.

* * * * *